US007144831B2

(12) United States Patent
Carter et al.

(10) Patent No.: US 7,144,831 B2
(45) Date of Patent: Dec. 5, 2006

(54) THREE-DIMENSIONAL NONWOVEN SUBSTRATE HAVING SUB-MILLIMETER ORIFICE STRUCTURE

(75) Inventors: Nick Carter, Mooresville, NC (US); Michael McCloskey, Monroe, NJ (US); Andrew Delaney, East Windsor, NJ (US)

(73) Assignee: Polymer Group, Inc., Charlotte, NC (US)

( * ) Notice: Subject to any disclaimer, the term of this patent is extended or adjusted under 35 U.S.C. 154(b) by 0 days.

(21) Appl. No.: 10/205,690

(22) Filed: Jul. 26, 2002

(65) Prior Publication Data

US 2004/0018791 A1 Jan. 29, 2004

(51) Int. Cl.
*D04H 1/46* (2006.01)
*D04H 3/10* (2006.01)
*D04H 5/02* (2006.01)

(52) U.S. Cl. ..... 442/408; 442/327; 442/381; 442/387; 442/409; 428/131; 428/170; 428/171; 428/172

(58) Field of Classification Search ..... 442/327, 442/381, 387, 408, 409; 428/131
See application file for complete search history.

(56) References Cited

U.S. PATENT DOCUMENTS 2,862,251 A * 12/1958 Kalwaites ..... 264/119
3,485,706 A 12/1969 Evans
4,588,630 A 5/1986 Shimalla
4,614,679 A * 9/1986 Farrington et al. ..... 428/138
4,741,941 A * 5/1988 Englebert et al. ..... 428/71
4,925,722 A 5/1990 Jeffers
5,026,587 A 6/1991 Austin et al.
5,098,764 A 3/1992 Drelich et al.
5,223,319 A * 6/1993 Cotton et al. ..... 428/131
5,643,653 A * 7/1997 Griesbach et al. ..... 428/120
5,830,555 A 11/1998 Srinivasan et al.
5,932,316 A * 8/1999 Cree et al. ..... 428/182
6,060,149 A 5/2000 Nissing et al.
6,132,841 A 10/2000 Guthrie et al.
RE38,505 E * 4/2004 James et al. ..... 428/156

* cited by examiner

*Primary Examiner*—Norca L. Torres-Velazquez
(74) *Attorney, Agent, or Firm*—Wood, Phillips, Katz, Clark & Mortimer

(57) ABSTRACT

The present invention is directed to a nonwoven fabric having a combination of a planar background element and projection elements to form a three-dimensional pattern, and a plurality of durable sub-millimeter orifices that extend at least partially through the depth of the three-dimensional pattern. The three-dimensional image of the non-apertured nonwoven fabric enhances the treatment, cleaning or cleansing performance due to pronounced surface projections that come in contact with the object to be treated or cleaned, and provide air passageways that are parallel to the plane of the substrate. Incorporation of sub-millimeter orifices in the nonwoven fabric, which extend through at least part of the nonwoven fabric, allow for transmission of fluids, as well as applied or embedded chemistries, from one side or surface of the substrate, or from a region internal to the nonwoven fabric, to the side which is in communication with the formed orifice.

7 Claims, 10 Drawing Sheets

THREE-DIMENSIONAL NONWOVEN SUBSTRATE HAVING SUB-MILLIMETER ORIFICE STRUCTURE

TECHNICAL FIELD

The present invention relates generally to a nonwoven fabric, and specifically to an engineered nonwoven fabric having a combination of a planar background element and at least one projection element to form a three-dimensional pattern, and a plurality of durable sub-millimeter orifices that extend at least partially through the depth of the three-dimensional pattern, which results in a sufficiently resilient material imminently suitable for numerous applications including the treatment, cleaning and/or cleansing of surfaces.

BACKGROUND OF THE INVENTION

The general use of nonwoven fabrics as a component in cleaning and/or cleansing articles is well known in the art. Various cleaning products, and specifically personal hygiene, baby and hard surface wipes, are commercially available which utilize one or more layers of nonwoven fabrics in the construction of said wipe. Substantially, these wipes are two-dimensional or planar in construction. As the surface topography of such two-dimensional wipes is inherently restricted by the composition of the wipe, frictional cleaning induced by the composition is limited, thus necessitating increased consumption of said wipe to effect satisfactory levels of cleanliness or other treatment of the surface.

Attempts have been made to induce three-dimensionality into the conventional wipe in order to improve cleaning performance. Prior art materials such as certain high-end consumer baby wipes have incorporated an elastic film to induce crenulation of the resultant wipe surface. While this practice can induce a limited level of three-dimensionality, that effect is transitory and can be easily removed when the wipe is distended during subsequent converting processes and/or end-use by the consumer.

Similarly, cleaning wipes have also been fabricated by application of various embossing processes. Again, these processes impart a three-dimensionality that can be reduced, if not removed, from the surface topography of the wipe when subjected to distention and pressure forces encountered during converting and use.

Substrates of particular importance in the treatment, cleaning, and cleansing market include those fabrics that are imparted with macroscopic apertures, or otherwise exhibit regions devoid of substrate matrix, wherein such apertures are greater than about 0.5 millimeter in diameter. It is has been conjectured by the fabricators of these facial cleansing products practicing the use of such apertured fabric that the presence of the macroscopic apertures improve the ability of the substrate to quickly build a beneficial lather during the cleansing process.

The presence of macroscopic apertures in a facial cleansing product has been found to be difficult and complex to fabricate due to a need to have an absolute minimum in the occurrences of occluded apertures. Occlusion of the aperture, for example by the fibrous matrix of a nonwoven substrate, has multiple deleterious effects. First, the occlusion results in an expected reduction of efficacy during a lather generation procedure due to the further constriction of the occlusion by the buildup of applied detergent agents. Second, an apertured substrate is difficult to fabricate so as to be functional and at the same time aesthetically pleasing. The very real problem of aesthetic appeal to the end-user is based on the fact that the human eye is attracted to variation in repeating patterns. An intermittent occlusion, even if only subtle in degree, will result in the user perception of a low quality product. The need for uniformity of apertures must be anticipated during the fabrication process and substrate material rejected should the aperture clarity at any time fall outside of predetermined specifications, thus leading to an exceedingly high level of potential substrate material being rejected.

There remains a need for a nonwoven substrate, which exhibits resilient three-dimensionality combined with a plurality of orifices, which extend through at least part of the plane of the substrate, that allows for transmission of fluids, as well as other applied or embedded chemistries, from one side or surface of the substrate, or from a region internal to the substrate, to the side which is in communication with the formed orifice. Said orifices are durably formed so as to be sub-millimeter in diameter, with the range of about 0.03 to 0.5 millimeter being optimal so as to avoid deleterious occlusion and objectionable aesthetic performance, and yet allow for fluidic communication.

SUMMARY OF THE INVENTION

The present invention is directed to a nonwoven fabric having a combination of a planar background element and projection elements to form a three-dimensional pattern, and a plurality of durable sub-millimeter orifices that extend at least partially through the depth of the three-dimensional pattern. The three-dimensional image of the non-apertured nonwoven fabric enhances the treatment, cleaning or cleansing performance due to pronounced surface projections that come in contact with the object to be treated or cleaned, and provide air passageways that are parallel to the plane of the substrate. Incorporation of sub-millimeter orifices in the nonwoven fabric, which extend through at least part of the nonwoven fabric, allow for transmission of fluids, as well as applied or embedded chemistries, from one side or surface of the substrate, or from a region internal to the nonwoven fabric, to the side which is in communication with the formed orifice.

In accordance with one aspect of the present invention, nonwoven fabrics are formed, which have at least one three-dimensional pattern imparted to the fabric. The three-dimensional pattern includes a combination of a planar background element with a projection or extension element that protrudes out of, or way from, the planar background element. Both the planar background element and the projection element exhibit an obverse side or surface and a reverse side or surface. Connecting the obverse and reverse side is an intermediate region. A plurality of durable orifices, having a dimension of between about 0.03 and 0.5 millimeter, extend completely through the planar background element and/or the projection element, thus allowing fluidic communication between the reverse and obverse sides of the planar background element and/or projection element.

In accordance with a further aspect of the present invention, three-dimensional nonwoven fabrics are formed which comprise a plurality of durable orifices, said orifices having a dimension of between about 0.03 and 0.5 millimeter, which extend only through the reverse or obverse side of the planar background element and/or of the projection element, thus allowing fluidic communication between the intermediate region and the reverse or obverse sides of the planar background element and/or of the projection element. It is within the purview of the present invention that a given nonwoven fabric may comprise a plurality of orifices that allow fluid communication only between the intermediate region and the reverse side, while simultaneously, a plurality of orifices allow fluid communication only between the intermediate region and the obverse side.

In accordance with a further aspect of the present invention, three-dimensional nonwoven fabrics are formed which comprise a plurality of durable orifices, said orifices having a dimension of between about 0.03 and 0.5 millimeter, wherein a first population of said orifices having a first geometric profile or regional positioning extend only through the planar background element, while simultaneously, a second population of said orifices having a second geometric profile or regional positioning extend only through the projection element.

A number of suitable methods for manufacturing the present durable nonwoven fabric can be employed, wherein said suitable methods include displacement of the component fiber out of a common planar background and include a means for removing or displacing fibers from the desired orifice regions. Representative manufacturing methods include the use, singularly or in combination, of mechanical, thermal or adhesive bonding or integrating technologies with mechanical or thermal fibrous displacement or removal methods.

An exemplary manufacturing technology suitable for forming nonwoven fabrics in accordance with the present invention comprises the steps of providing a precursor fibrous web that is subjected to hydraulic energy. By this hydroentanglement method, a fibrous batt is formed and integrated into a three-dimensional nonwoven fabric by application of hydraulic energy on a three-dimensional image transfer device. The image transfer device defines three-dimensional asperities against which the precursor web is forced during hydroentanglement process, whereby the fibrous constituents of the web are simultaneously imparted with a given combination of planar background elements, projection elements and a plurality of orifices, by movement of the fibrous into regions upon and between the three-dimensional asperities of the transfer device.

It is further contemplated by the present invention that the use of a nonwoven fabric comprising a combination of planar background elements, projection elements, and a plurality of sub-millimeter orifices, can be employed in treatment, cleaning, and cleansing applications, whereby the three-dimensional image of the nonwoven fabric induces treatment or cleaning performance due to pronounced surface projections which come in contact with an object. The nonwoven fabric further provides durable orifices that allow for fluidic communication between the contact surfaces and intermediate region of the overall nonwoven construct. The nonwoven fabric can be designed to facilitate optimal performance when used in the wetted state and when treated with or subject to numerous chemical agents, by specific inclusion of fibrous components exhibiting favorable compatibility.

A particularly beneficial aspect of the material of the present invention includes the loading of treatment, cleaning or cleansing agents onto the reverse side of the projection elements such that the agents is expressly and controllably dispersed through the orifice and onto the obverse side of the projection element. Such controllable dispersion enables the so treated nonwoven fabric to be used in treatment and cleaning applications whereby said agents are desirably retained and specifically dosed over an extended period of time in which the treated fabric is utilized.

Other features and advantages of the present invention will become readily apparent from the following detailed description, the accompanying drawings, and the appended claims.

BRIEF DESCRIPTION OF THE DRAWINGS

The invention will be more easily understood by a detailed explanation of the invention including drawings. Accordingly, drawings which are particularly suited for explaining the invention are attached herewith; however, is should be understood that such drawings are for explanation purposes only and are not necessarily to scale. The drawings are briefly described as follows.

DETAILED DESCRIPTION

Figure 1:
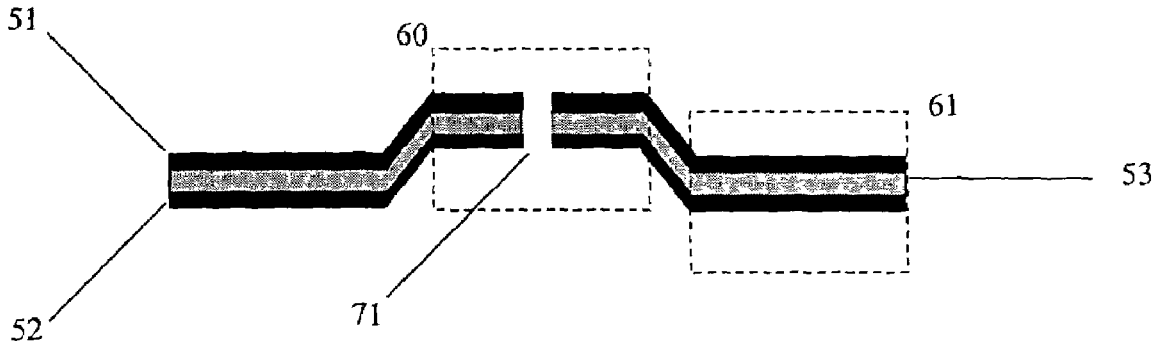
FIG. 1 is a side view of a nonwoven fabric formed in accordance with the present invention, wherein said nonwoven fabric exhibits a sub-millimeter orifice completely extending from the obverse side to the reverse side of the projection element.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

Nonwoven fabrics are used in a wide variety of medical, hygiene and industrial applications whereby the engineered qualities of the fabric can be advantageously employed. These types of fabrics differ from traditional woven or knitted fabrics in that the fabrics are produced directly from a fibrous mat, eliminating the traditional textile manufacturing processes of multi-step yarn preparation, and weaving or knitting. Integration of the fibers or filaments of the fabric acts to provide the fabric with a useful level of integrity. Subsequent to integration, the fabric can be further enhanced by the application of binder compositions and/or by thermal stabilization of the entangled fibrous matrix.

The present invention is directed to a nonwoven fabric having a combination of a planar background element and at least one projection element to form a three-dimensional pattern, and a plurality of durable sub-millimeter orifices that extend at least partially through the depth of the nonwoven fabric. The three-dimensional image of the non-apertured nonwoven fabric induces the treatment, cleaning or cleansing performance due to pronounced surface projections that come in contact with the cleaning surface and provide air passageways that are parallel to the plane of the substrate. Incorporation of sub-millimeter orifices in the nonwoven fabric, which extend through at least part of the nonwoven fabric, allow for transmission of fluids, as well as applied or embedded chemistries, from one side or surface of the substrate, or from a region internal to the substrate, to the side which is in communication with the formed orifice.

In accordance with the present invention, nonwoven fabrics are formed that have at least one three-dimensional pattern imparted to the fabric. The three-dimensional pattern includes a combination of a planar background element with a projection or extension element that protrudes out of, or way from, the planar background element. Both the planar background element and the projection element exhibit an obverse side or surface and a reverse side or surface. Connecting the obverse and reverse side is an intermediate region. A plurality of durable orifices, having a dimension of between about 0.03 and 0.5 millimeter, extend completely through the planar background element and/or the projection element, thus allowing fluidic communication between the reverse and obverse sides of the planar background element and/or projection element.

Three-dimensional nonwoven fabrics can also be formed wherein said nonwoven fabric comprise a plurality of durable orifices, said orifices having a dimension of between about 0.03 and 0.5 millimeter, which extend through only part of the planar background element and/or of the projection element, thus allowing fluidic communication between the intermediate region and the reverse or obverse sides of the planar background element and/or of the projection element. It is within the purview of the present invention that a given nonwoven fabric may comprise a plurality of orifices that allow fluid communication only between the intermediate region and the reverse side, while simultaneously, a plurality of orifices allow fluid communication only between the intermediate region and the obverse side.

Optionally, it is in with the purview of the present invention that three-dimensional nonwoven fabrics are formed which comprise a plurality of durable orifices, said orifices having a dimension of between about 0.03 and 0.5 millimeter, wherein a first population of said orifices having a first geometric profile or regional positioning extend only through the planar background element, while simultaneously, a second population of said orifices having a second geometric profile or regional positioning extend only through the projection element.

It is envisioned that a plurality of orifices can be formed in at least one of the elements of the nonwoven fabric of the present invention. Suitable orifice types are selected from the group consisting of: those orifices which extend from the obverse side to the intermediate region; those orifices which extend from the reverse side to the intermediate region; those orifices which extend from the reverse side to the obverse side of the material, thus extending completely through the intermediate region; and the blending of the aforementioned orifice types in a single three-dimensional nonwoven fabric. Further, the orifices may be formed in the regions selected from the group consisting of the background planar region only, the projection element only, and the combination thereof. The geometric cross-sectional profile of the sub-millimeter orifice so imparted is not a critical limitation to the present invention.

Figure 2:
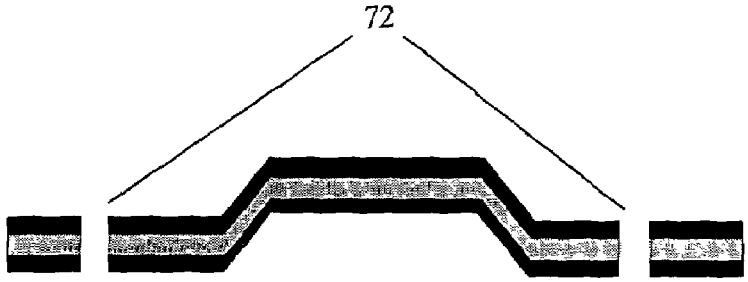
FIG. 2 is a side view of a nonwoven fabric formed in accordance with the present invention, wherein said nonwoven fabric exhibits sub-millimeter orifices completely extending from the obverse side to the reverse side of the planar background element.
Figure 3:
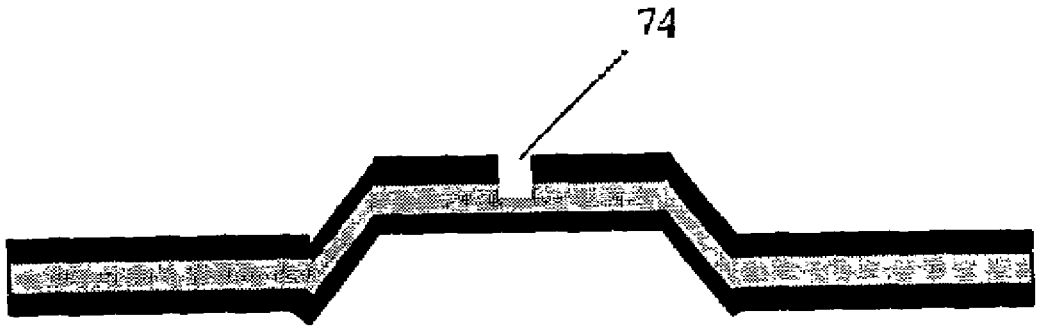
FIG. 3 is a side view of a nonwoven fabric formed in accordance with the present invention, wherein said nonwoven fabric exhibits a sub-millimeter orifice extending from the intermediate region through to the obverse side of a projection element.
Figure 4:
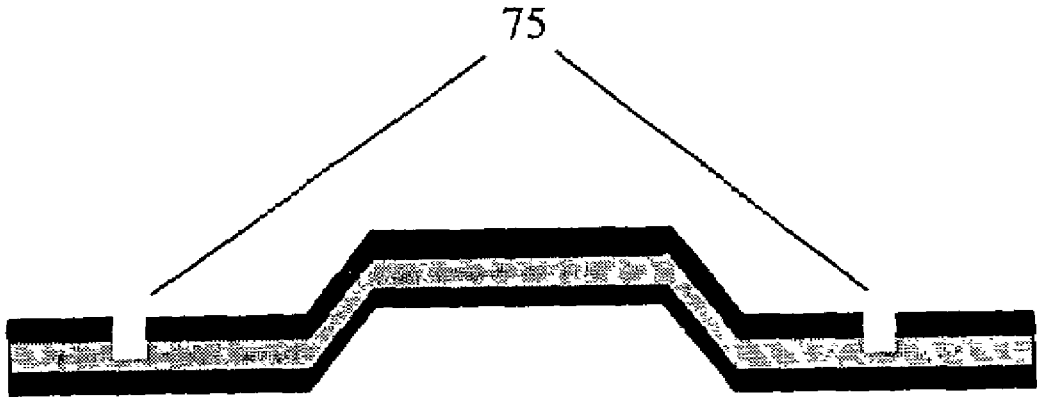
FIG. 4 is a side view of a nonwoven fabric formed in accordance with the present invention, wherein said nonwoven fabric exhibits sub-millimeter orifices extending from the intermediate region through to the obverse side of the planar background element.
Figure 5:
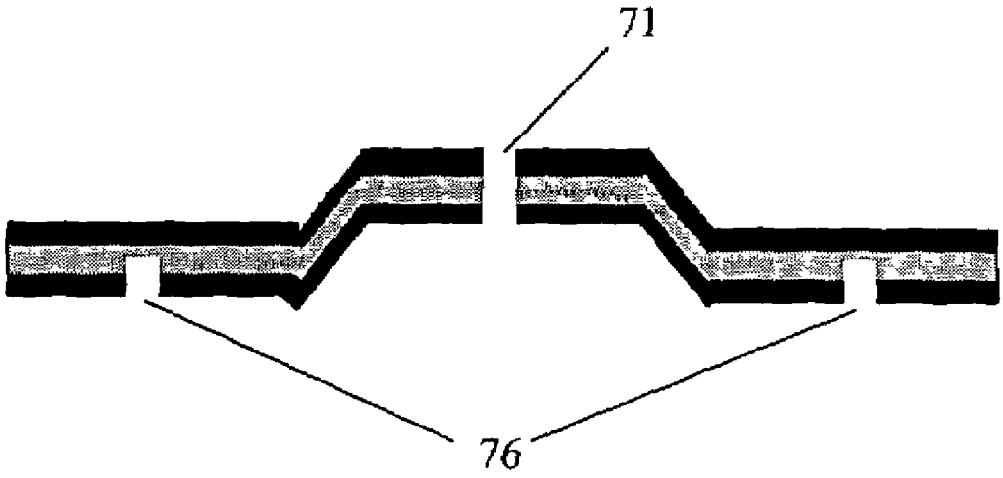
FIG. 5 is a side view of a nonwoven fabric formed in accordance with the present invention, wherein said nonwoven fabric exhibits a sub-millimeter orifice completely extending from the reverse side to the obverse side of the projection element, and sub-millimeter orifices extending from the internal region to the reverse side of the planar background region.
Figure 6:
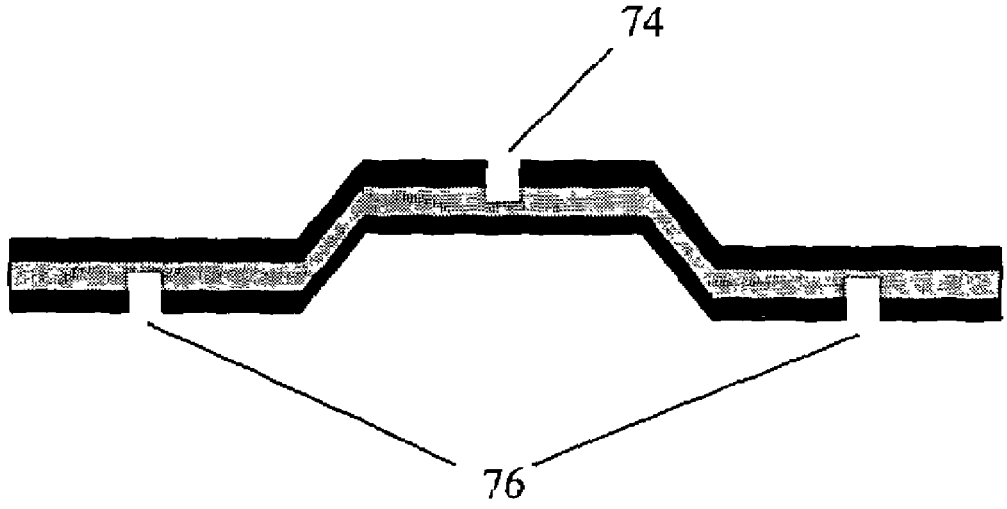
FIG. 6 is a side view of a nonwoven fabric formed in accordance with the present invention, wherein said nonwoven fabric exhibits a sub-millimeter orifice extending from the intermediate region through to the obverse side of the projection element and sub-millimeter orifices extending from the internal region to the reverse side of the planar background region.

FIGS. 1 through 6, depict representative constructs reflecting the integration of said orifice types with said regional selections. FIG. 1 represents a nonwoven fabric having an obverse side 51, a reverse side 52, and an intermediate region 53, wherein said fabric has a planar background region 61 and a projection element 60. A sub-millimeter orifice extends completely through the projection element 71, is shown. FIG. 2 represents a nonwoven fabric wherein a sub-millimeter orifice 72 extends completely through the planar background element. FIGS. 3 and 4 show a partial depth sub-millimeter orifice positioned in the projection element and the planar background element, respectively. FIGS. 5 and 6 present representative combinations of complete and partial depth orifices, and controlled orifice presentation, respectively.

It should be noted that FIGS. 1 through 6 depict the reverse side of the projection element as being shifted away from the reverse side of the planar background region. It is within the purview of the present invention that the reverse side of the projection element and the reverse side of the planar background element may be essentially coplanar.

Manufacture of a nonwoven fabric embodying the principles of the present invention is initiated by providing a batt or layer of fibrous components. The fibrous batt can be comprised of finite-length staple fibers or essentially continuous filaments selected from natural or synthetic composition, of homogeneous or mixed fiber length. Suitable natural fibers include, but are not limited to, cotton, wood pulp and viscose rayon. Synthetic fibers, which may be blended in whole or part, include thermoplastic and thermoset polymers. Thermoplastic polymers suitable for use include polyolefins, polyamides and polyesters. The thermoplastic polymers may be further selected from homopolymers; copolymers, conjugates and other derivatives including those thermoplastic polymers having incorporated melt additives or surface-active agents. Staple lengths are selected in the range of 0.25 inch to 8 inches, the range of 1 to 3 inches being preferred and the fiber denier selected in the range of 1 to 15, the range of 2 to 6 denier being preferred for general applications. The profile of the fiber is not a limitation to the applicability of the present invention.

For application in a given medical, hygiene or industrial product, a nonwoven fabric must exhibit a combination of specific physical characteristics. For example, the nonwoven fabrics used in cleansing of the face should be soft and drapeable so as to conform to the contours of the face and yet withstand brisk agitation inherent to facial cleansing procedures. Nonwoven fabrics used in hard surface cleaning applications, such as for work counters, flooring, and furniture, must be resistant to abrasion and tinting yet also exhibit sufficient strength and tear resistance.

The fibrous composition of the three-dimensional imaged nonwoven fabric can be specifically chosen in light of compatibility with a certain end-use performance requirement and/or the cleaning agent to be impregnated therein or applied thereon. For example, if a water-based chemistry is to be applied, a hydrophilic naturally derived fiber such as rayon or a hydrophilic melt additive in a thermoplastic staple fiber would facilitate in the nonwoven fabric absorbing a controlled amount of the chemistry. Should it be known that an abrasive cleaning surface facing material is desirable, a polypropylene staple fiber selected from the upper denier range of staple fibers would be advised.

It is within the purview of the present invention that a scrim can be incorporated in the formation of the resulting nonwoven fabric. The purpose of the scrim is to reduce the extensibility of the resultant three-dimensional imaged nonwoven fabric, thus reducing the possibility of three-dimensional image distortion and further enhancing fabric durability. Suitable scrims include unidirectional monofilaments, bi-directional monofilaments, expanded or apertured films, thermoplastic continuous filament nonwoven fabrics (i.e. spunbond), and the blends thereof.

It is also within the purview of the present invention that a binder material can be either incorporated as a fusible component fiber in the formation of the precursor nonwoven web or as a liquid adhesive applied after nonwoven fabric formation. The binder material will further improve the durability or otherwise provide enhanced cleaning performance of the resultant imaged nonwoven fabric during use.

A number of suitable methods for manufacturing the present three-dimensional nonwoven fabric can be employed, where in said suitable methods include, singularly or in combination; a means for displacement of the component fiber out of a common planar background; a means for removing or displacing fibers from the desired orifice regions, and a means for integrating the component fibers into a substrate that can be rolled or sheeted into a useful intermediate material or end-use article. Representative manufacturing methods include the combined use of: mechanical displacement of the fibrous component out of a common planar orientation, such as by use of a foraminous surface; mechanical or thermal displacement or removal of the fibrous component from the defined orifice regions, such as by hydraulic energy and laser ablation; and mechanical, thermal or chemical bonding and integrating technologies. Nonwoven fabrics exhibiting the combined three-dimensional property with the presence of at least partial depth orifices can occur in such a way as the three-dimensional property is imparted first followed by formation of the orifices, the orifices are formed first followed by displacement into a three-dimensional structure, or the three-dimensional property and the orifices are formed simultaneously. When a nonwoven fabric in accordance with the present invention is to exhibit partial depth orifices through both sides of the fabric, such orifices may be formed in line by application of suitable means to both sides of the fabric, or run serially whereby first one set of partial depth orifices are formed on one side, the fabric temporarily wound into a roll, then the rerun in an inverted state.

An exemplary manufacturing technology comprises the steps of providing a precursor fibrous batt that is subjected to simultaneous mechanical displacement and integration by means of hydraulic energy. U.S. Pat. No. 3,485,706, to Evans, hereby incorporated by reference, discloses processes for effecting hydroentanglement of nonwoven fabrics. More recently, hydroentanglement techniques have been developed which impart images or patterns to the entangled fabric by effecting hydroentanglement on three-dimensional image transfer devices. Such three-dimensional image transfer devices are disclosed in U.S. Pat. No. 5,098,764, hereby incorporated by reference, with the use of such image transfer devices being desirable for providing a fabric with enhanced physical properties as well as having a pleasing appearance.

Figure 7:
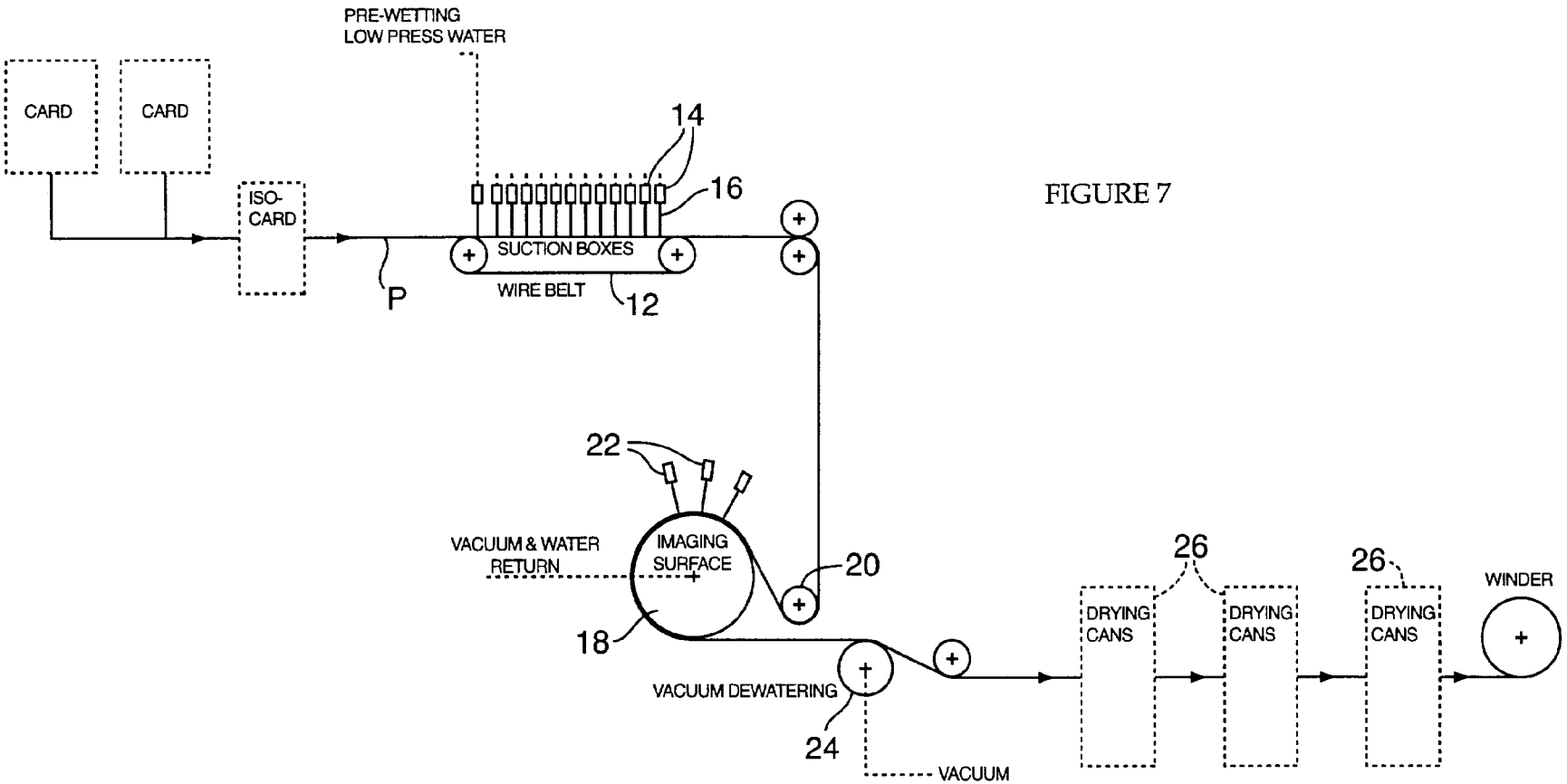
FIG. 7 is a diagrammatic view of a representative device suitable for the manufacture of the nonwovens in accordance with the present invention.

With reference to FIG. 7, therein is illustrated a non-limiting apparatus suitable for practicing the present method for forming a nonwoven fabric. The fabric is formed from a fibrous matrix preferably comprising staple length fibers, but it is within the purview of the present invention that different types of fibers, or fiber blends, and inclusion of an optional scrim layer, can be employed. The image transfer device shown as imaging device 18 can be selected from a broad variety of foraminous surfaces, including flexible continuous belts, linked segments, and cylindrical drums. Use of a foraminous surface results in projection elements of entangled constituent fibers which extended out of a planar background element, the projection elements creating high points that are particular effective at enhancing cleaning or treatment performance while maintaining air passageways parallel to the substrate surface. Further, finite orifice forming elements extend out of the foraminous surface, these finite elements having a diameter of between 0.03 and 0.5 millimeter. The orifice forming elements work in conjunction with the applied mechanical force to distribute the fibrous component away from the elements and thus form a durable orifice. Suitable fine elements may be fabricated from plastic and/or metal, and may be integral to the foraminous surface, or formed separately and durably attached to the foraminous surface.

EXAMPLES

Example 1

Using a representative forming apparatus as illustrated in FIG. 7, a nonwoven fabric was made in accordance with the present invention by providing a precursor web comprising 100 percent by weight polyester fibers as supplied by Wellman as Type T-472 PET, 1.2 dpf by 1.5 inch staple length. The precursor fibrous batt was entangled by a series of entangling manifolds such as diagrammatically illustrated in FIG. 7. The apparatus includes a foraminous-forming surface in the form of belt 12 upon which the precursor fibrous batt P is positioned for pre-entangling by entangling manifold 14. In the present examples, each of the entangling manifolds 14 included 120-micron orifices spaced at 42.3 per inch, with the manifolds successively operated at 100, 300, and 600 pounds per square inch, with a line speed of 45 feet per minute. The precursor web was then dried using two stacks of steam drying cans at 300° F. The precursor web had a basis weight of 1.5 ounce per square yard (plus or minus 7%).

The precursor web then received a further 1.5 ounce per square yard air-laid layer of Type-472 PET fibrous batt. The precursor web with fibrous batt was further entangled by a series of entangling manifolds 14, with the manifolds successively operated at 100, 300, and 600 pounds per square inch, with a line speed of 45 feet per minute. The entangling apparatus of FIG. 7 further includes an imaging drum 18 comprising a three-dimensional image transfer device for effecting imaging of the now-entangled layered precursor web. The image transfer device includes a moveable imaging surface which moves relative to a plurality of entangling manifolds 22 which act in cooperation with three-dimensional asperities and finite elements defined by the imaging surface of the image transfer device to effect formation of projection elements extending outwardly from a planar background element, wherein said planar background element includes a sub-millimeter orifice extending completely through the planar background element. The entangling manifolds 22 included 120 micron orifices spaced at 42.3 per inch, with the manifolds operated at 3000 pounds per square inch each.

Figure 8:
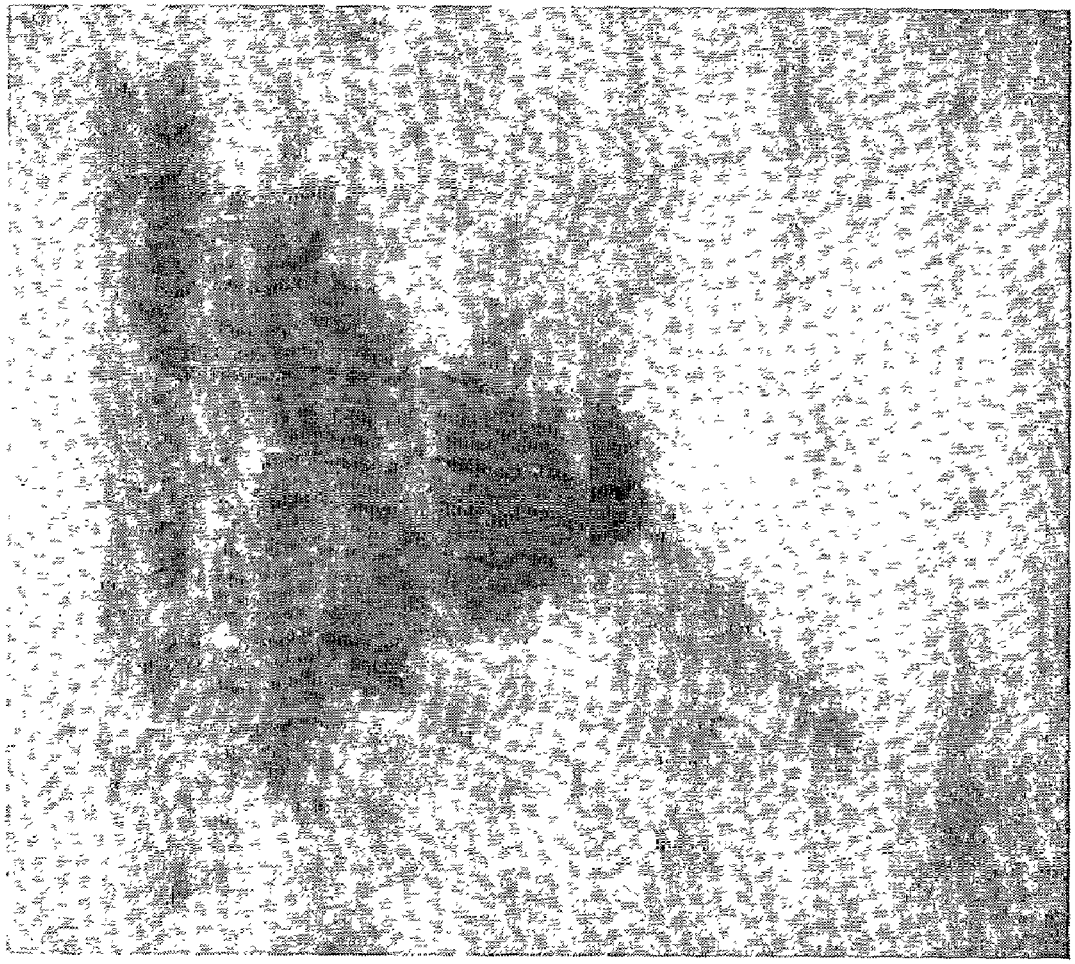
FIG. 8 is a microphotograph of a nonwoven fabric, exhibiting a durable sub-millimeter orifice extending completely through the planar background element; magnification is approximately 14× utilizing a top light source.
Figure 9:
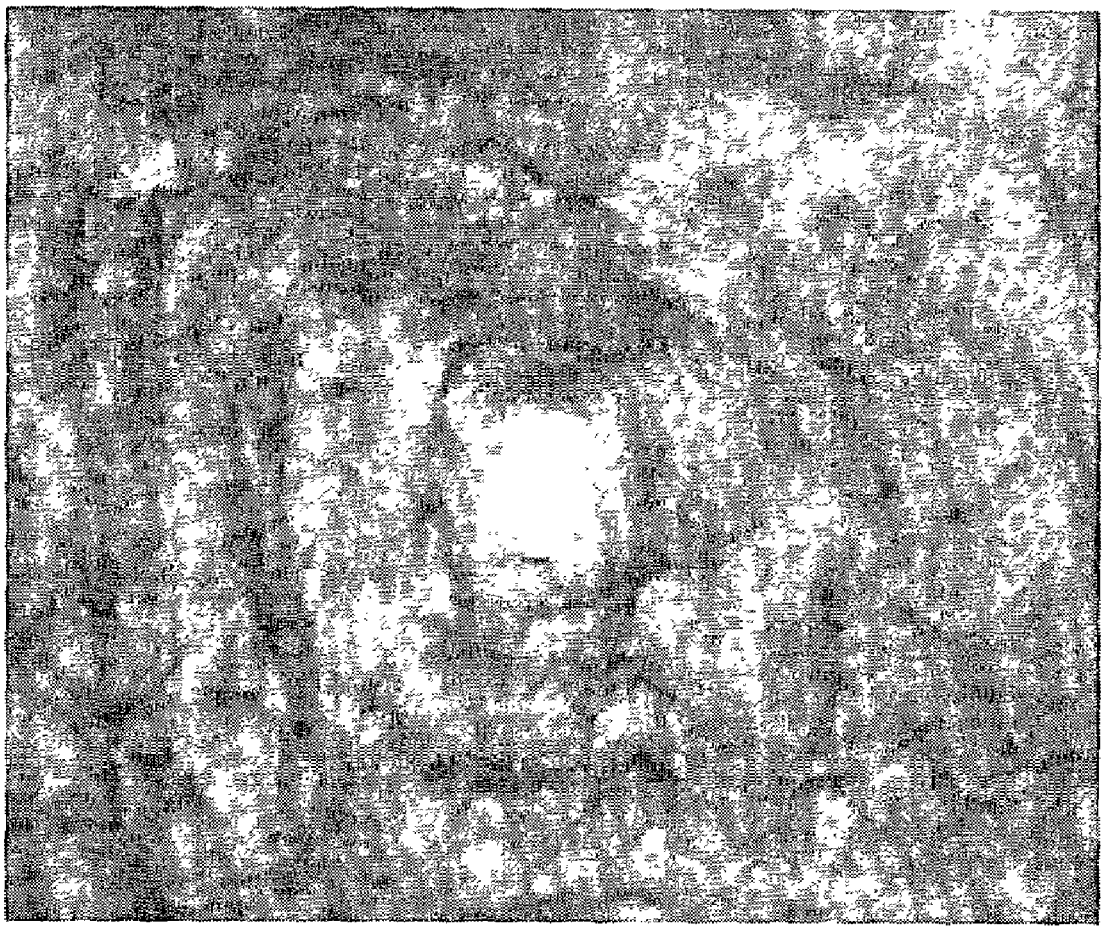
FIG. 9 is a microphotograph of a nonwoven fabric, exhibiting a durable sub-millimeter orifice extending completely through the planar background element; magnification is approximately 14× utilizing a transmitted light source.

FIGS. 8 and 9 depict nonwoven fabric formed in accordance with Example 1.

Example 2

An imaged nonwoven fabric was fabricated by the method specified in Example 1, where in the alternative, the image transfer device induced formation of projection elements extending outwardly from a planar background element, wherein said projection element includes a sub-millimeter orifice extending completely through the projection element.

Figure 10:
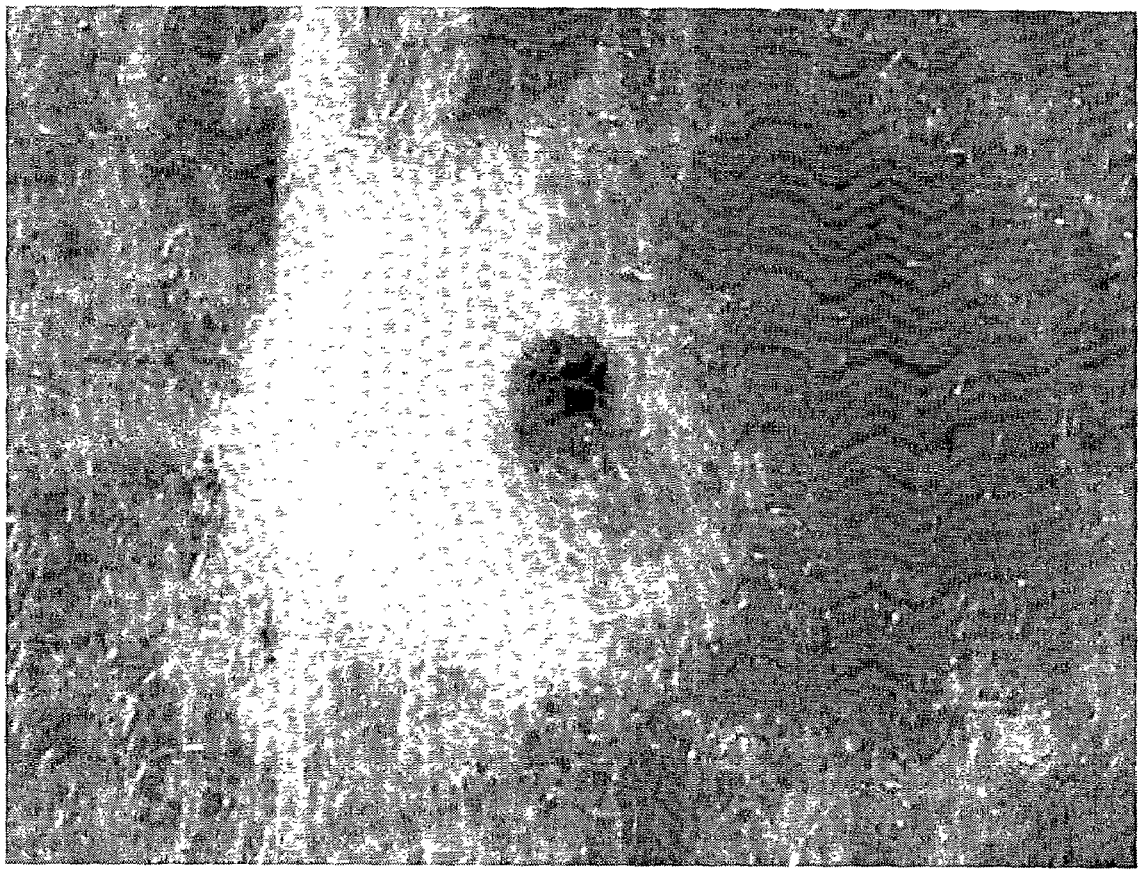
FIG. 10 is a microphotograph of a nonwoven fabric, exhibiting a durable sub-millimeter orifice extending completely through the projection element; magnification is approximately 14× utilizing a top light source.
Figure 11:
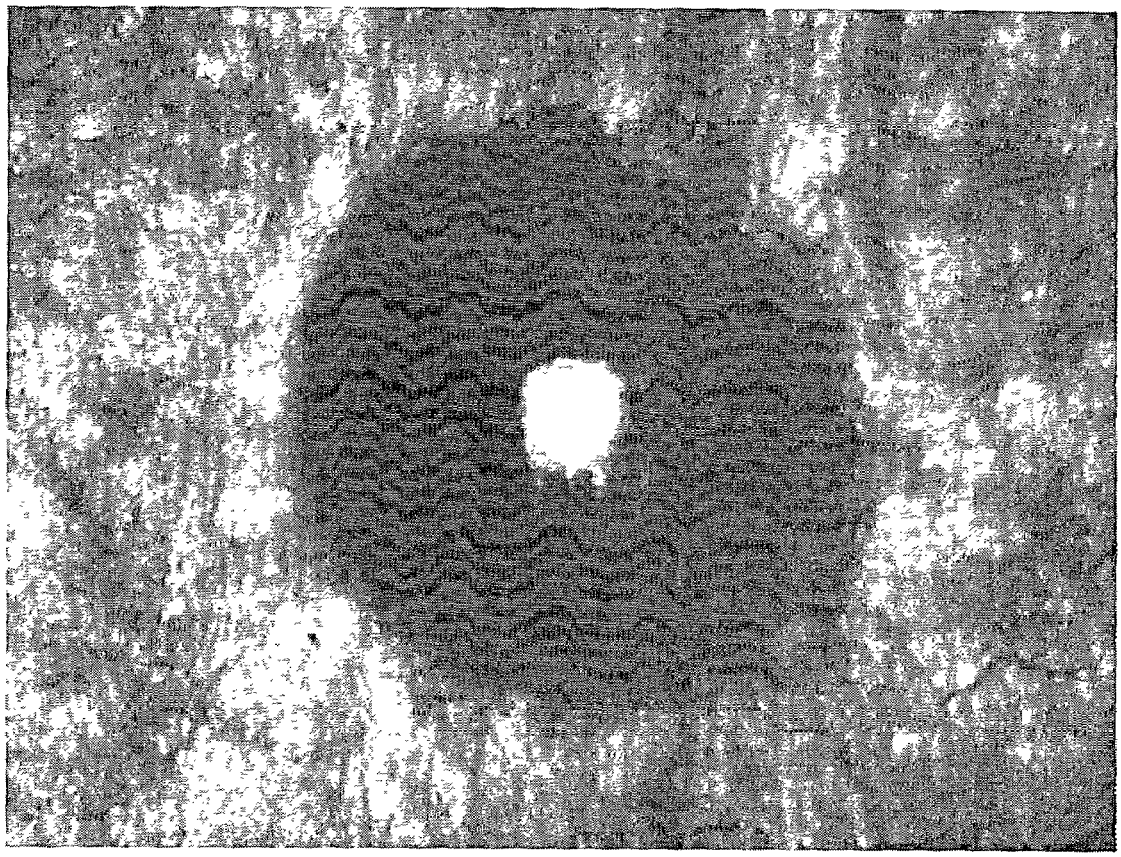
FIG. 11 is a microphotograph of a nonwoven fabric, exhibiting a durable sub-millimeter orifice extending completely through the projection element; magnification is approximately 14× utilizing a transmitted light source.

FIGS. 10 and 11 depict nonwoven fabric formed in accordance with Example 1.

Example 3

An imaged nonwoven fabric was fabricated by the method specified in Example 1, where in the alternative, the image transfer device induced formation of projection elements extending outwardly from a planar background element, wherein both said projection element and said planar background element includes sub-millimeter orifices extending completely through the respective elements.

Figure 12:
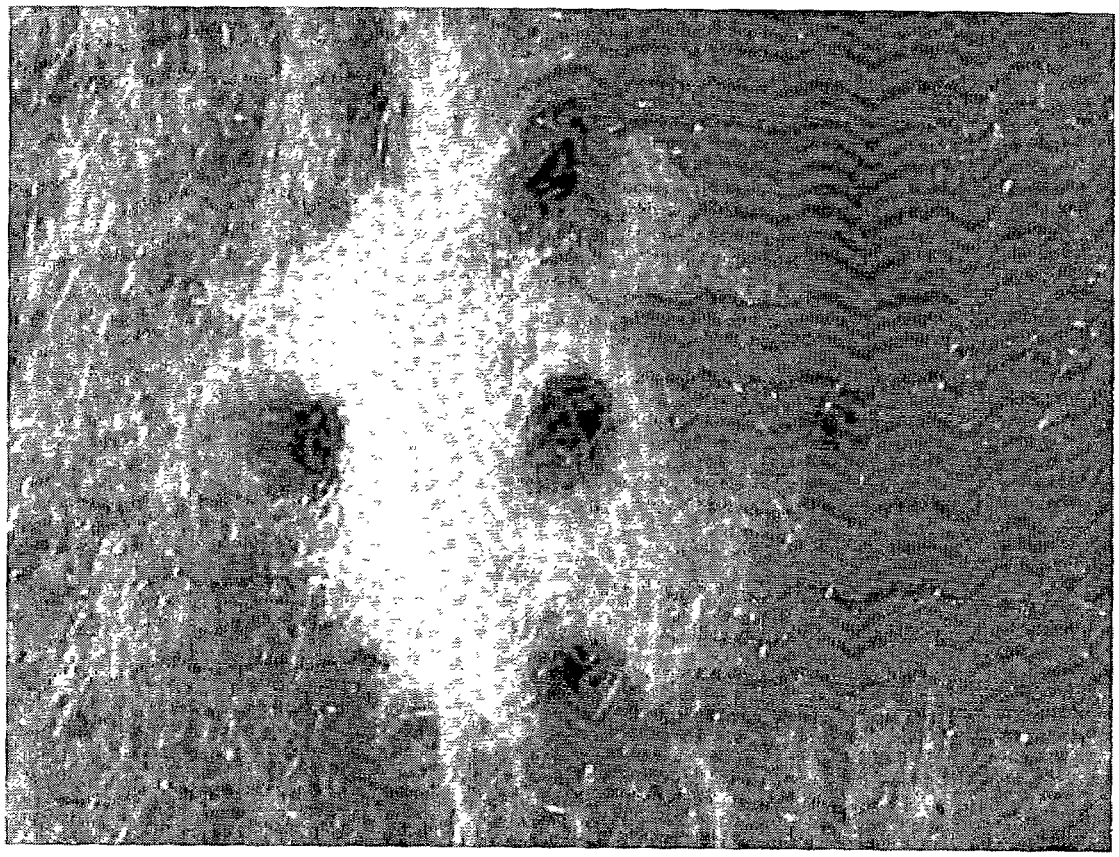
FIG. 12 is a microphotograph of a nonwoven fabric, exhibiting a durable sub-millimeter orifice extending completely through the projection element, and four sub-millimeter orifices extending completely through the planar background region surrounding the projection element; magnification is approximately 14× utilizing a top light source.
Figure 13:
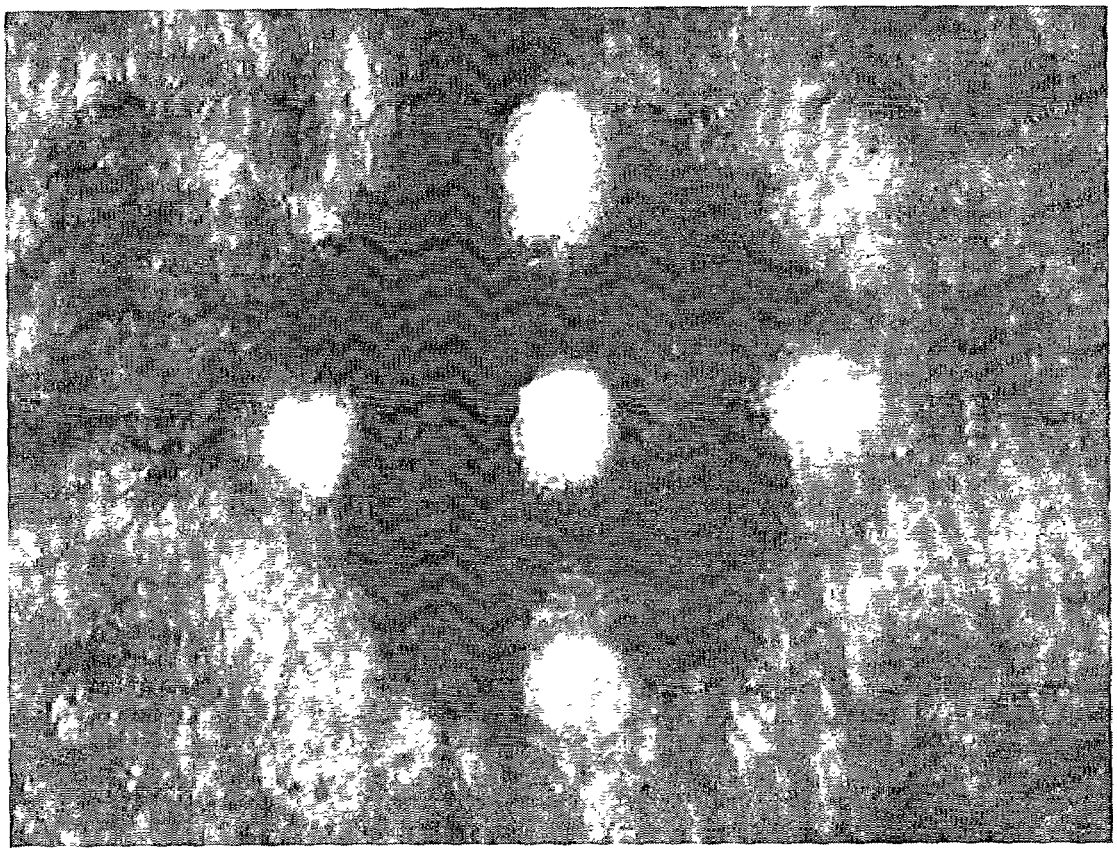
FIG. 13 is a microphotograph of a nonwoven fabric, exhibiting a durable sub-millimeter orifice extending completely through the projection element, and four sub-millimeter orifices extending completely through the planar background region surrounding the projection element; magnification is approximately 14× utilizing a transmitted light source.

FIGS. 12 and 13 depict nonwoven fabric formed in accordance with Example 1.

Nonwoven fabric comprising a combination of planar background elements, projection elements, and a plurality of orifices, can be employed in medical, hygiene and industrial applications whereby the three-dimensional image of the nonwoven fabric induces useful performance due to pronounced surface projections which come in contact with the surface and provide and the durable orifices allow for fluidic communication between the surfaces and intermediate region and/or reverse side of the overall construct. The imaged nonwoven fabric can be further designed to facilitate optimal performance when used in the wetted state and when treated with or subject to treatment, cleaning, and/or cleansing chemistries.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. An imaged nonwoven fabric comprising;

a) a planar background element, wherein said planar background element exhibits an obverse and a reverse side or surface connected by an intermediate region;

b) at least one projection element extending out from said planar background element, wherein said projection element exhibits an obverse and a reverse side or surface connected by an intermediate region, said at least one projection element having been formed by hydraulic displacement of fibers;

c) a plurality of orifices which extend partially through said fabric, from said intermediate region through at least one side or surface of at least one said planar background element or projection element, said plurality of orifices having been formed by hydraulic displacement of fibers; and d) wherein said orifices have a diameter of about 0.03 to 0.5 millimeter.

2. A nonwoven fabric as in claim 1, including a further plurality of orifices having a first geometric profile or regional positioning extending completely through the planar background element, and/or the projection element.

3. A nonwoven fabric as in claim 1, wherein the imaged nonwoven fabric is a substrate for a medical treatment product.

4. A nonwoven fabric as in claim 1, wherein the imaged nonwoven fabric is a substrate for an industrial cleaning product.

5. A nonwoven fabric as in claim 1, wherein the imaged nonwoven fabric is a substrate for a hygienic cleansing product.

6. A nonwoven fabric comprising;

a) a planar background element, wherein said planar background element exhibits an obverse and a reverse side or surface connected by an intermediate region;

b) at least one projection element extending out from said planar background element, wherein said projection element exhibits an obverse and a reverse side or surface connected by an intermediate region, said at least one projection element having been formed by hydraulic displacement of fibers;

c) a plurality of orifices which extend through at least one side or surface of at least one said planar background element or projection element, said plurality of orifices having been formed by hydraulic displacement of fibers; and d) wherein said orifices have a diameter of about 0.03 to 0.5 millimeter, wherein a first population of said orifices extend from the intermediate region of said projection element through the obverse or reverse side of said projection element and a second population of orifices extend from the intermediate region of said planar background element through the obverse or reverse side of said planar background element.

7. A nonwoven fabric comprising;

a) a planar background element, wherein said planar background element exhibits an obverse and a reverse side or surface connected by an intermediate region;

b) at least one projection element extending out from said planar background element, wherein said projection element exhibits an obverse and a reverse side or surface connected by an intermediate region, said at least one projection element having been formed by hydraulic displacement of fibers;

c) a plurality of orifices which extend through at least one side or surface of at least one said planar background element or projection element, said plurality of orifices having been formed by hydraulic displacement of fibers; and d) wherein said orifices have a diameter of about 0.03 to 0.5 millimeter, wherein a first population of said orifices having a first geometric profile or regional positioning extend from the intermediate region through the obverse or reverse side of said planar background element, and a second population of said orifices having a second geometric profile or regional positioning extend from the intermediate region through the obverse or reverse side of said projection element.

* * * * *